US006951244B1

(12) United States Patent
Hoger

(10) Patent No.: US 6,951,244 B1
(45) Date of Patent: Oct. 4, 2005

(54) HEAT EXCHANGER COMPRISING AN INLET OR OUTLET SUPPLY INSERT

(75) Inventor: Patrick Hoger, Saint Jean du Bois (FR)

(73) Assignee: Valeo Climatisation, La Verriere (FR)

( * ) Notice: Subject to any disclaimer, the term of this patent is extended or adjusted under 35 U.S.C. 154(b) by 0 days.

(21) Appl. No.: 09/125,567

(22) PCT Filed: Dec. 16, 1997

(86) PCT No.: PCT/FR97/02319

§ 371 (c)(1),
(2), (4) Date: Aug. 20, 1998

(87) PCT Pub. No.: WO98/28586

PCT Pub. Date: Jul. 2, 1998

(30) Foreign Application Priority Data

Dec. 23, 1996 (FR) ..... 96 15881

(51) Int. Cl.[7] ..... F28D 1/02
(52) U.S. Cl. ..... 165/153; 165/176; 165/178
(58) Field of Search ..... 165/153, 152, 165/176, 174

(56) References Cited

U.S. PATENT DOCUMENTS 4,967,834 A * 11/1990 Tokizaki et al. ..... 165/153
5,355,947 A 10/1994 Rasso, Jr. et al.
5,413,169 A 5/1995 Frazer et al.
5,544,702 A * 8/1996 Nishishita ..... 165/176
5,617,915 A * 4/1997 Kinugasa et al. ..... 165/153

* cited by examiner

*Primary Examiner*—Ira S. Lazarus
*Assistant Examiner*—Terrell McKinnon
(74) *Attorney, Agent, or Firm*—Morgan & Finnegan, LLP

(57) ABSTRACT

The heat exchanger has a plurality of stacked individual boxes for defining locally an inlet chamber and an outlet chamber for fluid. The heat exchanger includes an insert that comprises an inlet and outlet opening for fluid extended into the chambers by a body arranged for fluid communication of the opening with the first or second chamber. The insert that comprises a common part the body of which is provided with at least two openings capable of communicating with the first and second chambers, and it comprises a separating member for isolating the fluid currents between the opening and the chamber with which the opening must not communicate, the separating member being selected between two different shapes each corresponding to the fluid communication of the opening with one of the chambers.

20 Claims, 1 Drawing Sheet

HEAT EXCHANGER COMPRISING AN INLET OR OUTLET SUPPLY INSERT

BACKGROUND OF THE INVENTION

The invention relates to the technology of heat exchangers, in particular for motor vehicles.

Numerous methods for manufacturing heat exchangers for motor vehicles are known, regardless of whether it involves radiators for engine cooling systems or evaporators and condensers of air conditioning systems for the passenger space of the vehicle.

These heat exchangers comprise a serpentine circuit, which in certain cases may be formed from stacked, flat, individual boxes, through each of which the cooling fluid or the refrigerant flows in one direction then in the other, in a U-shaped path. Locally, usually at the upper part at the two ends of the branches of the U, the boxes are shaped so as to define two separated chambers, one for the inlet and the other for the outlet of the fluid. The inlet chambers of the various boxes communicate with one another, as do the outlet chambers The exchanger is connected to the remainder of the circuit for the admission and for the extraction of the fluid via parts called "supply inserts", which each replace a box at the site of the chambers. By choosing an appropriate shape for the part, the insert may communicate with the chamber immediately adjacent to the inlet or outlet orifice, or with the chamber the furthest therefrom, depending on whether it is wished to provide a fluid inlet insert or a fluid outlet insert.

To produce such inserts, units comprising at least three parts are generally used, the main ones of which are different according to whether it is wished to provide an inlet insert or an outlet insert (a more detailed explanation will be given on the manner in which the present inserts are produced with reference to FIGS. 1 and 2, which will be described further on).

BRIEF SUMMARY OF THE INVENTION

One of the objects of the invention is to propose a heat exchanger comprising a universal inlet or outlet supply insert, the structure of which enables the production of the heat exchanger to be simplified by:

- the reduction of the number of parts of each insert,
- the rationalization of the assembly program, by maximizing the number of common parts,
- simple assembly, with a correlative gain with respect to time and the production cost of the heat exchanger.

The insert is, in a manner known per se, an inlet or outlet supply insert for a heat exchanger, in particular a heat exchanger for a motor vehicle, this heat exchanger possessing a plurality of stacked individual boxes formed so as to define locally a first chamber, for the inlet or outlet of fluid, and a second chamber, respectively for the outlet or inlet of fluid, mutually juxtaposed and stretched out in the stacking direction of the boxes, this insert comprising a fluid inlet or outlet orifice generally oriented laterally with respect to the longitudinal direction of the chambers and extended inside the chambers by a body inserted into the stack of boxes, this body being formed as desired to bring the orifice into fluid communication either with the first chamber, adjacent to the orifice, or with the second chamber, adjacent to the first chamber and separated from the orifice by the interposition of the first chamber.

According to the invention, the insert comprises a basic part provided at the level of the body with at least two openings capable of being brought into fluid communication respectively with the first chamber and with the second chamber, and a separating member capable of isolating the fluid currents between the orifice and the chamber with which the orifice must not be brought into fluid communication, the shape and disposition of the separating member being chosen so as to bring the orifice into fluid communication either with the first chamber, or with the second chamber.

According to a certain number of advantageous subsidiary characteristics:

- the basic part is a monobloc part, advantageously made by molding a tubular blank.
- the insert body is provided with two groups of two openings, each of the groups comprising two opposite openings formed on two opposite lateral walls of the body;
- to allow the orifice to be brought into fluid communication with the first chamber, the separating member is in the form of a transverse partition dividing the internal volume of the body in the region situated between the two openings or groups of openings; this transverse partition is preferably positioned in the body by insertion into a lateral slot provided in one of the lateral walls of said body;
- to allow the orifice to be brought into fluid communication with the second chamber, the separating member is in the form of a guide ring introduced into the internal volume of the body at the level of the opening capable of being brought into fluid communication with the first chamber; this guide ring is preferably positioned in the body by fitting into the corresponding opening.

BRIEF DESCRIPTION OF THE DRAWIGNS

Other characteristics and advantages of the invention will become apparent from reading the detailed description given below, made with reference to the attached drawings.

DEATILED DESCRIPTION OF THE INVENTION

Figure 1:
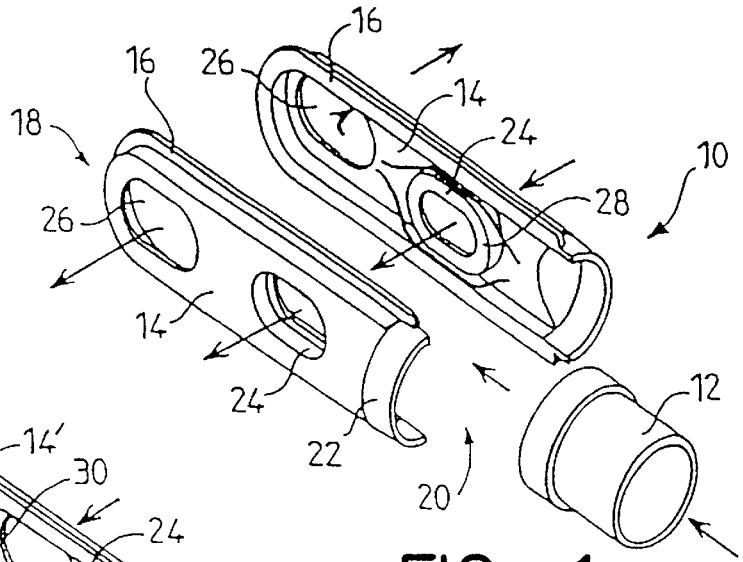
FIG. 1 PRIOR ART
FIGS. 1 and 2 are exploded perspective views of inserts of the prior art, respectively of an inlet insert and of an outlet insert.
Figure 2:
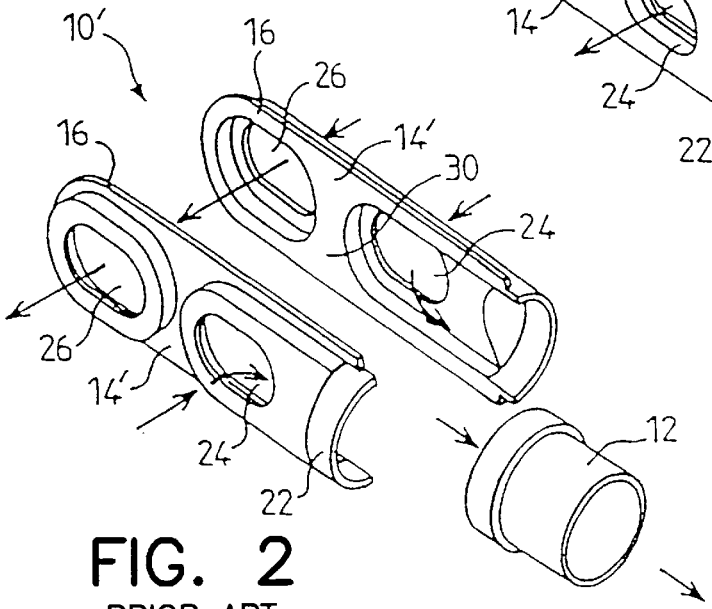
FIG. 2 PRIOR ART

On FIGS. 1 and 2, the references 10 and 10' designate, respectively, a fluid inlet insert and a fluid outlet insert according to the prior art.

These inserts each comprise a tubular element 12 for the inlet or the outlet of the fluid, and also two half-elements made of buckled sheet 14, 14 or 14', 14' which serve to make the element 12 communicate with the one of the two adjacent chambers of the heat exchanger.

The two half-elements 14, 14 or 14', 14' are joined by their peripheral edge 16, for example by tacking and fastening, welding or bonding, so as to form a hollow element, the one of the ends of which (rear end on the figures) 18 is closed and the opposite end 20 communicates with the element 12, which is fixed, for example, onto a cylindrical bearing surface 22 formed by the parts 14 or 14'.

Each of the parts 14 or 14' has an opening 24 allowing the element 12 to communicate with the adjacent chamber of the heat exchanger (which chamber will hereinafter be called "first chamber") and an opening 26 enabling the first chamber to communicate with the adjacent chamber (which hereinafter will be called "second chamber"), i.e. the first chamber comes to interposed between the second chamber and the element 12.

The inlet insert 10 has the purpose of supplying the fluid into the second chamber. To allow this admission without the fluids circulating in the first and the second chambers becoming mixed, the opening 24 of each of the parts 14 is provided in a boss 28 turned towards the interior of the hollow element and joined tightly to the boss 28 of the other part 14, to allow the passage of the orifices 24 by the fluid circulating in the first chamber without communication with the interior of the insert 10 and, on the contrary, bringing the second chamber to communicate by the opening 26 with the element 12 by the flow around the bosses 28, as can clearly be seen on the drawing of FIG. 1.

With regard to the outlet insert 10', an attempt is made to obtain a reverse action, i.e. a free passage of the insert by the fluid circulating in the second chamber via the openings 26 and bringing the element 12 to communicate with the first chamber, via the openings 24. To do this, the elements 14, 14' are tightly connected to one another by respective surfaces 30 extending along their joint face, which surround the openings 26 and allow only fluid communication between the opening 24 and the element 12.

It will be noted that the circulation directions described are only for guidance and given by way of example, and that it would also just as well operate in the opposite directions, for example with an extraction of fluid from the second chamber and an admission of fluid towards the first chamber; in this case, all the circulation directions would be reversed in relation to the drawings, the "inlet" insert becoming an "outlet" insert, and vice versa.

As can be noted, each of the inserts requires the assembly of three separate parts (12+14+14 or 12+14'+14'), the parts 14 and 14' of the two insert types being two different parts, therefore having to be formed in accordance with two separate manufacturing programs.

One of the objects of the present invention is to propose a simplified insert structure, with a reduction in the number of parts for each insert and simplification of the manufacturing program of each of the inserts.

Figure 3:
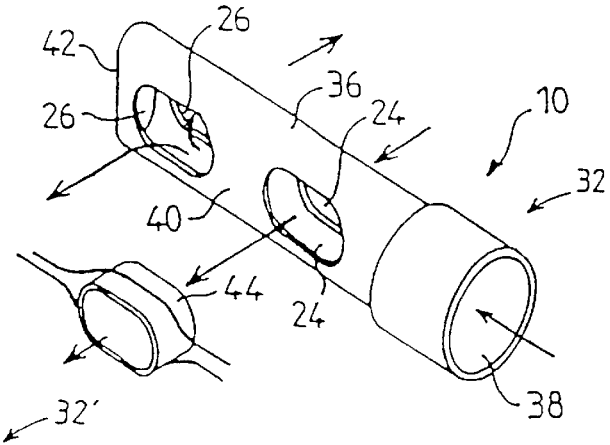
FIGS. 3 and 4 are exploded perspective views of inserts according to the invention, respectively of an inlet insert and of an outlet insert.
Figure 4:
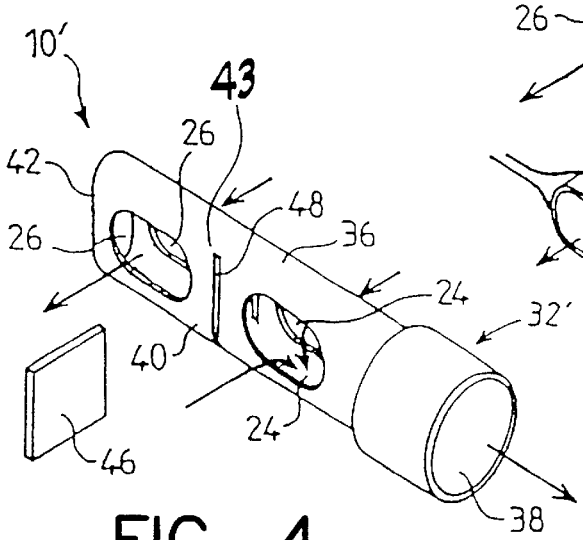

FIGS. 3 and 4 are similar to FIGS. 1 and 2, but for an insert according to the invention. On the figures the same numerical references have been used to designate functionally similar elements, in particular the openings 24 and 26. The directions of circulation of the fluid in the first and in the second chamber are also the same as on FIGS. 1 and 2.

The insert according to the invention, regardless of whether it concerns an inlet insert 32 or an outlet insert 32', is made from a common single element 36, for example an element made by molding a tubular blank.

This monobloc element 36 comprises a circular open end 38 intended to allow communication with the remainder of the circuit to which the heat exchanger is connected, and a body 40 provided with openings 24, 24 and 26, 26 and closed opposite the end 38 for example by a partition 42. The openings are provided in plane lateral walls 43 formed by flattening the initial tubular wall. It can be seen that the monobloc part 36 plays the same role as the three parts 12+14+14 or 12+14'+14' of FIGS. 1 and 2.

To individualize the insert as an inlet insert or an outlet insert, to the monobloc part 36 is added a supplementary part 44 (FIG. 3) or 46 (FIG. 4) allowing the fluid circulation to be provided as desired.

For the inlet insert (FIG. 3), the part 44 is a guide ring forcibly inserted into the openings 24 and connecting them to one another, which has the effect of preventing any fluid communication between the internal volume of the monobloc part 36 and the internal volume of the ring 44—therefore with the first chamber. The fluid comes to flow around the outer surface of the ring 44 in the volume contained between this ring and the internal wall of the body 40, to end in the second chamber and pass through the openings 26.

In the case of an outlet insert, as illustrated in FIG. 4, a partition 46 is introduced through a slot 48 made in the lateral wall 43 of the body 40 into an intermediate zone between the openings 24 and 26. This partition, the dimensions of which are chosen to prevent any fluid communication between the openings 24 and 26—and therefore between the first and the second chambers—, therefore comes to isolate these chambers by allowing the fluid passing through the openings 26 to circulate in the second chamber without, for all that, disturbing the flow of the fluid in the first chamber via the openings 24.

What is claimed is:

1. A heat exchanger for a motor vehicle, comprising:

a plurality of stacked individual boxes formed so as to define a first chamber, for the inlet or outlet of fluid, and a second chamber, respectively for the outlet or inlet of fluid, which are mutually juxtaposed and stretched out in the stacking direction of the boxes; and an inlet supply insert or outlet supply insert; the insert comprising a fluid inlet or outlet orifice oriented generally laterally in relation to a longitudinal direction of the chambers and extended inside the chambers by a body inserted into the stack of boxes, the body being formed to bring the orifice into fluid communication either with the first chamber, adjacent to the orifice, or with the second chamber, adjacent to the first chamber and separated from the orifice by the interposition of the first chamber, wherein the insert comprises:

a basic part provided at the level of the body with at least two openings adapted to be brought into fluid communication respectively with the first chamber and with the second chamber, and a separating member adapted to isolate the fluid currents between the orifice and the chamber with which the orifice must not be brought into fluid communication, the shape and arrangement of the separating member being chosen so as to bring the orifice into fluid communication either with the first chamber or with the second chamber.

2. The heat exchanger according to claim 1, wherein the basic part is a monobloc part made by molding a tubular blank.

3. The heat exchanger according to claim 1, wherein the body of the insert includes two groups of two openings, each of the groups comprising two opposite openings disposed on two opposite lateral walls of the body.

4. The heat exchanger according to claim 3, wherein the separating member comprises a transverse partition for dividing the internal volume of the body of the region situated between the two groups of openings to enable fluid communication between the orifice and the first chamber.

5. The heat exchanger according to claim 4, wherein the transverse partition is positionable in the body by insertion into a lateral slot provided in one of the lateral walls of the body.

6. The heat exchanger according to claim 1, wherein the separating member comprises a guide ring introduced into an internal volume of the body at the level of one of the openings capable of being brought into fluid communication with the first chamber.

7. The heat exchanger according to claim 6, wherein the guide ring is positionable in the body by fitting into the corresponding opening.

8. The heat exchanger according to claim 1, wherein the separating member comprises a transverse partition for dividing the internal volume of the body of the region situated between the two openings to enable fluid communication between the orifice and the first chamber.

9. The heat exchanger according to claim 8, wherein the transverse partition is positionable in the body by insertion into a slot provided on the body.

10. A motor vehicle including the heat exchanger of claim 1.

11. An inlet or outlet supply insert for a heat exchanger having a first chamber and a second chamber, the insert comprising:

a body having a fluid inlet or outlet orifice oriented generally laterally in relation to a longitudinal direction of the chambers and at least two openings adapted to be brought in fluid communication with the first chamber and the second chamber, respectively; and a separating member, adapted to engage the body, for isolating fluid flow between the fluid orifice and one of the chambers.

12. The insert according to claim 11, wherein the body comprises a monobloc part made by molding a tubular blank.

13. The insert according to claim 11, wherein the body includes two groups of two openings, each of the groups comprising two opposite openings disposed on opposite lateral walls of the body.

14. The insert according to claim 11, wherein the separating member comprises a transverse partition for dividing an internal volume of the body of the region situated between the two openings to enable fluid communication between the fluid orifice and the first chamber.

15. The insert according to claim 11, wherein the separating member comprises a guide ring introduced into an internal volume of the body via the opening adapted to be brought into fluid communication with the first chamber.

16. A heat exchanger comprising:

a first chamber;

a second chamber; and the insert of claim 12.

17. The heat exchanger according to claim 16, wherein the first and second chambers are defined by a plurality of stacked individual boxes.

18. A motor vehicle including the heat exchanger of claim 16.

19. A method of assembling the insert of claim 11, comprising:

molding a tubular blank to form the body; and engaging the separating member with the body to prevent fluid flow between the fluid orifice and one of the chambers.

20. An inlet or outlet supply insert for a heat exchanger having a first chamber and a second chamber, the insert comprising:

a body having a fluid inlet or outlet orifice oriented generally laterally in relation to the longitudinal direction of the chambers and at least two openings adapted to be brought in fluid communication with the first chamber and the second chamber, respectively; and means, adapted to engage the body, for isolating fluid flow between the fluid orifice and one of the chambers.

* * * * *